US007722036B2

(12) United States Patent
Saitsu

(10) Patent No.: US 7,722,036 B2
(45) Date of Patent: May 25, 2010

(54) SHEET CONVEYING DEVICE AND IMAGE FORMING SYSTEM

(75) Inventor: Yasushi Saitsu, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 418 days.

(21) Appl. No.: 11/585,461

(22) Filed: Oct. 23, 2006

(65) Prior Publication Data

US 2007/0164499 A1 Jul. 19, 2007

(30) Foreign Application Priority Data

Jan. 16, 2006 (JP) ..... 2006-007471
Jul. 4, 2006 (JP) ..... 2006-184398

(51) Int. Cl.
*B65H 5/34* (2006.01)

(52) U.S. Cl. ..... 271/270; 271/3.15; 271/3.17

(58) Field of Classification Search ..... 271/270, 271/3.15, 3.17
See application file for complete search history.

(56) References Cited

U.S. PATENT DOCUMENTS 4,835,574 A * 5/1989 Ohi ..... 355/27
6,021,888 A * 2/2000 Itoh et al. ..... 198/783
2004/0188916 A1* 9/2004 Tsukamoto et al. ..... 271/110

FOREIGN PATENT DOCUMENTS

JP 03-227848 10/1991
JP 2002-311659 10/2002
JP 2004-026398 1/2004

OTHER PUBLICATIONS

Translation of JP Office Action for Appl. 2006-184393, mailed Jun. 3, 2008, 6 pgs.
Translation of Examined JP Utility Model Application Publication No. S61-39721, 19 pgs.
Translation of Unexamined JP Utility Model Application Publication No. S63-194857, 12 pgs.

* cited by examiner

*Primary Examiner*—Patrick H Mackey
*Assistant Examiner*—Howard Sanders
(74) *Attorney, Agent, or Firm*—Squire, Sanders & Dempsey L.L.P.

(57) ABSTRACT

A sheet conveying device connected between image forming device and post-processing device of which sheet conveying speed is higher than that of image forming device. The sheet conveying device includes: feed-in roller for feeding in a sheet ejected from image forming device; conveying roller for conveying the sheet; ejection roller for ejecting the sheet to post-processing device; conveying path from feed-in roller to ejection roller; and controller for controlling sheet conveying speeds of the rollers, wherein the controller performs control such that: when sheet conveying device feeds in the sheet ejected from image forming device, the conveying speeds of the rollers are the same as conveying speed at which image forming device ejects the sheet; and when image forming device has completed ejection of a trailing edge of the sheet, the conveying speeds of the rollers are the same as conveying speed at which post-processing device feeds in the sheet.

8 Claims, 4 Drawing Sheets

SHEET CONVEYING DEVICE AND IMAGE FORMING SYSTEM

This application is based on Japanese Patent Applications No. JP2006-007471 filed on Jan. 16, 2006, and No. JP2006-184398 filed on Jul. 4, 2006, the entire of which is hereby incorporated by reference.

FIELD OF THE INVENTION

The present invention relates to a sheet conveying device connected between an image forming device and a post-processing device, and relates to an image forming system.

BACKGROUND OF THE INVENTION

There has been used a post-processing device that conducts post-processing such as punching processing, stapling processing and sorting processing for sheets on which an image has been formed. For the purpose of making an option sorter connectable with outer equipment of plural types, as a post-processing device, there is proposed a technology to detect, by using an option sorter, the conveying speed for the sheet conveyed from the outer equipment, and thereby to control the conveying speed for the sheet in accordance with the detected conveying speed (for example, see Patent Document 1: Japanese Unexamined Patent Publication TOKKAI No. H03-227848). In many cases, the conveying speed for the sheet is usually adjusted at an entrance portion of a post-processing device as stated above.

However, when the conveying speed of the post-processing device is higher than the conveying speed of the image forming device, a sheet is stretched because of a speed difference when the sheet is conveyed to the post-processing device from the image forming device, and the image surface is rubbed by a conveying roller, which has been a problem. In the case of an image employing toner containing wax, in particular, the conveying roller rubs the sheet under the condition that wax is not solidified sufficiently, because the melting point of the wax is low, which has resulted in easy generation of uneven gloss.

When the conveying speed of the image forming device is different from that of the post-processing device, speed control of acceleration and deceleration is necessary on either one of the image forming device and the post-processing device, and for controlling speed acceleration and deceleration, it is necessary to secure a conveying path with a sufficient length, and it requires a load of providing an extra control mechanism on the image forming device or post-processing device, which has resulted in problems of large-sized apparatuses and complicated controls.

In a case where plural post-processing devices are connected to a single image forming device, neither acceleration nor deceleration is necessary between connected post-processing devices. Therefore, if a conveying path having a sufficient length for controlling acceleration and deceleration is provided on each post-processing device, conveying paths and control mechanism will be wasteful.

A subject of the invention is to prevent uneven gloss caused by acceleration of conveying speed in the case of conveying a sheet from an image forming device to a post-processing device whose conveying speed is higher than that of the image forming device.

SUMMARY OF THE INVENTION

In an aspect of the invention, there is provided a sheet conveying device connected between an image forming device for forming an image and a post-processing device of which sheet conveying speed is higher than a sheet conveying speed of the image forming device, the sheet conveying device including:

a feed-in roller for feeding in a sheet ejected from the image forming device;

a conveying roller for conveying the sheet;

an ejection roller for ejecting the sheet to the post-processing device;

a conveying path from the feed-in roller to the ejection roller; and a controller for controlling sheet conveying speeds of the feed-in roller, conveying roller, and ejection roller, wherein the controller performs control such that:

when the sheet conveying device feeds in the sheet ejected from the image forming device, the conveying speeds of the feed-in roller, conveying roller, and ejection roller are the same as a conveying speed at which the image forming device ejects the sheet; and when the image forming device has completed ejection of a trailing edge of the sheet, the conveying speeds of the feed-in roller, conveying roller, and ejection roller are the same as a conveying speed at which the post-processing device feeds in the sheet.

In another aspect of the invention, there is provided an image forming system, including:

an image forming device for forming an image;

a post-processing device of which sheet conveying speed is higher than a sheet conveying speed of the image forming device; and a sheet-conveying device, connected between the image forming device and post-processing device, for feeding in a sheet ejected from the image forming device and ejecting the sheet to the post-processing device, the sheet-conveying device including:

a feed-in roller for feeding in a sheet ejected from the image forming device;

a conveying roller for conveying the sheet;

an ejection roller for ejecting the sheet to the post-processing device;

a conveying path from the feed-in roller to the ejection roller; and a controller for controlling sheet conveying speeds of the feed-in roller, conveying roller, and ejection roller, wherein the controller performs control such that:

when the sheet conveying device feeds in the sheet ejected from the image forming device, the conveying speeds of the feed-in roller, conveying roller, and ejection roller are the same as a conveying speed at which the image forming device ejects the sheet; and when the image forming device has completed ejection of a trailing edge of the sheet, the conveying speeds of the feed-in roller, conveying roller, and ejection roller are the same as a conveying speed at which the post-processing device feeds in the sheet.

DESCRIPTION OF THE PREFERRED EMBODIMENT

Figure 1:
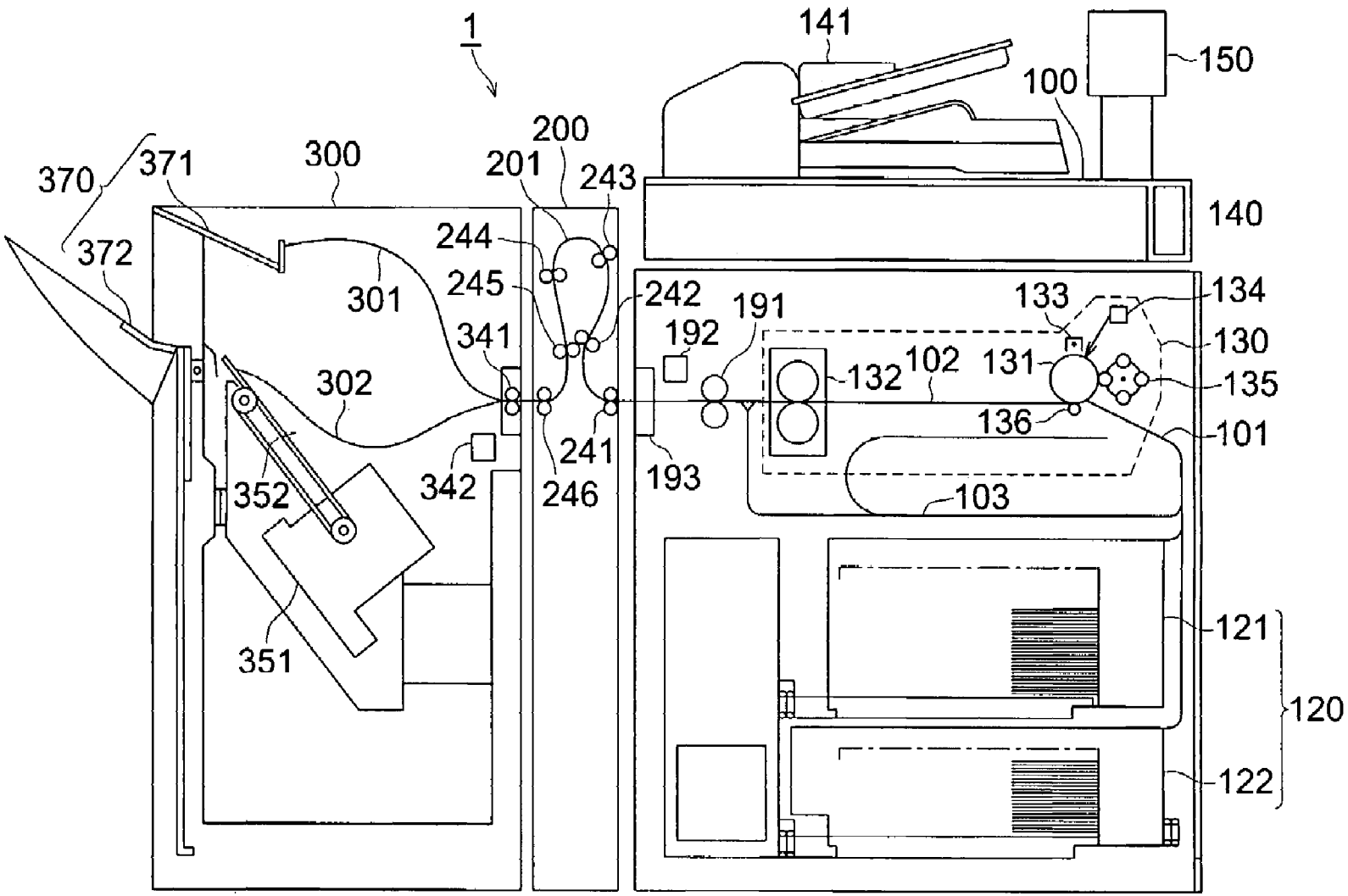
FIG. 1 is a schematic structural diagram of image forming system 1 in an embodiment of the invention.

A preferred embodiment of the invention will be described in detail as follows, referring to the drawings.

FIG. 1 shows a schematic structure of image forming system 1 in an embodiment of the invention.

As shown in FIG. 1, image forming system 1 includes image forming device 100, sheet conveying device 200 and post-processing device 300.

Image forming device 100 is provided with sheet feeding section 120 having plural sheet housing sections 121 and 122, image forming section 130, image reading section 140, automatic document conveying section 141, operation section 150, sheet ejection roller 191, sheet ejection sensor 192 and with sheet ejection outlet 193. Further, in the image forming device 100, there are provided sheet feeding path 101 through which the sheets are fed to image forming section 130 from sheet housing sections 121 and 122, conveying path 102 covering from image forming section 130 to sheet ejection outlet 193 through sheet ejection roller 191 and conveying path for reverse side 103 that conducts reverse conveying.

Each of the sheet housing sections 121 and 122 houses sheets for image forming by collecting them in a respective group of the same paper sheet type and same sheet size, and feeds them to image forming section 130.

The image forming section 130 forms a color image on a sheet. In the image forming section 130, photoconductor 131 is charged by charging section 133, then, the photoconductor 131 is subjected to exposure-scanning by a laser beam emitted from exposure section 134 based on image data of YMCK so that an electrostatic latent image is formed thereon, and the electrostatic latent image on the photoconductor 131 is developed by developing section 135 with toner in each color containing wax, thus, a toner image is transferred onto a sheet in transfer section 136. Then, an image is formed by heat-fixing the toner image on the sheet in fixing section 132.

Image reading section 140 reads a document sheet as image data. Specifically, a reflected beam resulting through reflection on the document sheet after being emitted from a light source is read by a CCD (Charge Coupled Device) image sensor. When using automatic document conveying section 141, document sheets are conveyed to the image reading section 140 one by one from a bundle of documents set on the automatic document conveying section 141, so that images are read.

Operation section 150 is equipped with various types of keys such as a numeral key and a start key. Further, the operation section 150 is equipped with a touch panel formed integrally with a display section such as LCD (Liquid Crystal Display), and it detects a position touched by a finger tip of a user or a touch pen, to receive operational instructions from the user.

Sheet ejection roller 191 ejects a sheet on which an image has been formed, from sheet ejection outlet 193. Sheet ejection sensor 192 is a sensor to detect a sheet, and it detects a leading edge and a trailing edge of the sheet that is ejected from sheet ejection outlet 193.

Sheet conveying device 200 is connected between image forming device 100 and post-processing device 300, and it feeds in a sheet ejected from image forming device 100 and ejects the sheet to post-processing device 300. As shown in FIG. 1, the sheet conveying device 200 has therein feed-in roller 241, conveying rollers 242, 243, 244 and 245, sheet ejection roller 246 and conveying path 201 covering from feed-in roller 241 to sheet ejection roller 246. The aforesaid conveying path 201 is longer than a length in the conveying direction of the maximum sheet size processable by image forming device 100 and post-processing device 300. Further, the conveying path 201 is a flex conveying path, and it is longer than a linear distance from feed-in roller 241 to an ejection roller. Owing to this, sheet conveying device 200 can be made small.

Post-processing device 300 is equipped with feed-in roller 341, entrance sensor 342, staple processing section 351, stacker 352, fixed sheet ejection tray 371 and up-and-down sheet ejection tray 372. Further, on the post-processing device 300, there are provided conveying path 301 for ejecting a sheet to fixed sheet ejection tray 371 and conveying path 302 for ejecting a sheet to up-and-down sheet ejection tray 372.

Entrance sensor 342 is a sensor to detect a sheet, and it detects a leading edge and a trailing edge of the sheet that is fed in from feed-in roller 341.

Staple processing section 351 conducts staple processing for a bundle of sheets stacked on stacker 352. A bundle of sheets which has been subjected to staple processing is ejected to up-and-down sheet ejection tray 372.

Sheets conveyed through conveying path 302 are stacked on stacker 352. When conducting shift sheet ejection, shift processing is carried out for a bundle of sheets conveyed to stacker 352. A bundle of sheets which has been subjected to shift processing is ejected to up-and-down sheet ejection tray 372.

Even in the case of the mode where post-processing such as staple processing or shift processing is not carried out, sheets are ejected to up-and-down sheet ejection tray 372 through conveying path 302, when forming a large amount of images.

Fixed sheet ejection tray 371 is a tray to which the sheets are ejected when a small amount of images are formed. Up-and-down sheet ejection tray 372 is a tray which can be ascended and descended depending on a thickness of a bundle of sheets to be ejected.

Figure 2:
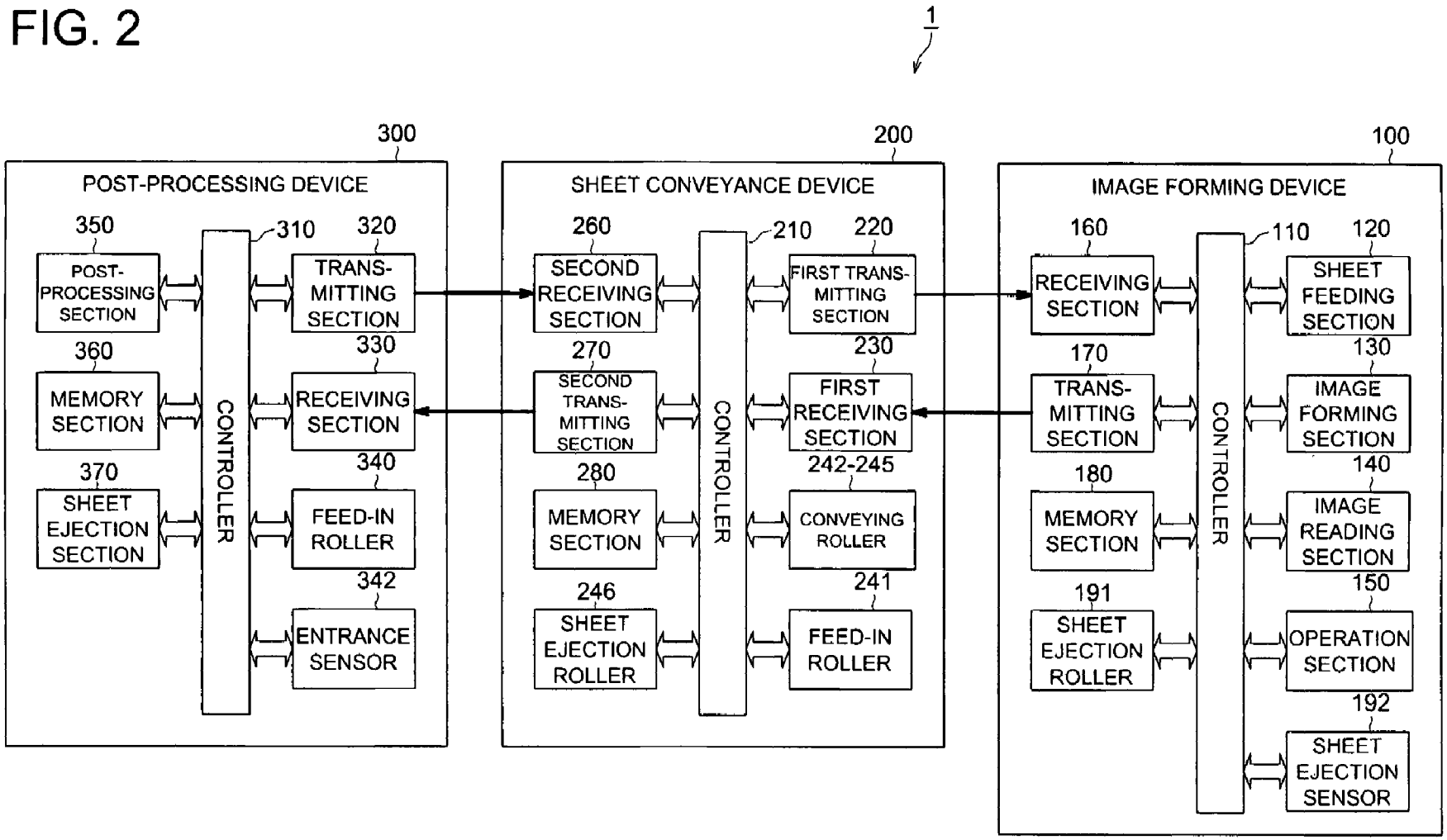
FIG. 2 is a block diagram showing functional constitutions of image forming device 100, sheet conveying device 200 and post-processing device 300 of the image forming system 1.

FIG. 2 is a block diagram showing a structure of control of image forming device 100, sheet conveying device 200 and post-processing device 300 which construct image forming system 1. Herein, description of the structure described in FIG. 1 will be omitted.

AS shown in FIG. 2, image forming device 100 is equipped with controller 110, sheet feeding section 120, image forming section 130, image reading section 140, operation section 150, reception section 160, transmission section 170, memory section 180, sheet ejection roller 191, and sheet ejection sensor 192.

Controller 110 controls respective portions of image forming device 100 on an overall control basis, in accordance with an instruction inputted from operation section 150 or from reception section 160. The controller 110 is equipped with CPU (Central Processing Unit), ROM (Read Only Memory) and RAM (Random Access Memory), while, CPU reads a program stored in ROM, then, loads the program into a work area in RAM, and carries out various types of processing in collaboration with the programs.

Sheet feeding section 120 feeds sheets housed in the sheet housing sections 121 and 122 to image forming section 130.

Reception section 160 receives data from sheet conveying device 200. For example, the reception section 160 receives, from sheet conveying device 200, the information on types of post-processing showing a type of post-processing such as punch processing, folding processing or staple processing executable in post-processing device 300, at the time of power-on.

Transmission section 170 transmits data to sheet conveying device 200. For example, in the case of forming images, the transmission section 170 transmits to the sheet conveying device 200 the information on sheet ejection conveying speed showing conveying speed V1 for ejecting sheets by image forming device 100, the information on sheet type such as a sheet size and weight and the information of image forming such as color or black and white.

Memory section 180 stores data to be used for respective processing executed by image forming device 100 and data generated by various types of processing executed by image forming device 100.

Sheet ejection roller 191 ejects, from the sheet ejection outlet 193, the sheet on which images have been formed.

As shown in FIG. 2, sheet conveying device 200 is equipped with controller 210, first transmission section 220, first reception section 230, second reception section 260, second transmission section 270, memory section 280, feed-in roller 241, conveying rollers 242-245 and sheet ejection roller 246.

Controller 210 controls respective portions of sheet conveying device 200 on an overall control basis. The controller 210 is equipped with CPU, ROM and RAM, and CPU reads a program stored in ROM, then, load the program into a work area in RAM, and carries out various types of processing in collaboration with the programs.

First transmission section 220 transmits data to image forming device 100. For example, second transmission section 220 transmits information on a type of post-processing to image forming device 100, at the time of power-on.

First reception section 230 receives data from image forming device 100. For example, first reception section 230 receives, from image forming device 100, the information on conveying speed (V1) for ejecting a sheet by image forming device 100, the information on a type of sheet and information on image forming, during image forming operation.

Second reception section 260 receives data from post-processing device 300. For example, the second reception section 260 receives, from post-processing device 300, the information on conveying speed for feeding in showing conveying speed V3 for feeding in a sheet in post-processing device 300 and the information on a type of post-processing, at the time of power-on.

Second transmission section 270 transmits data to post-processing device 300. For example, the second transmission section 270 transmits information on a type of sheet and image forming information to post-processing device 300, during image forming operation.

Controller 210 controls driving of feed-in roller 241, conveying rollers 242, 243, 244 and 245 and sheet ejection roller 246, and controls conveying speed for a sheet in sheet conveying device 200. Specifically, the controller 210 makes the conveying speed in the case of feeding in the sheet ejected from image forming device 100 to be the same as conveying speed V1 for ejecting the sheet by image forming device 100, and when the ejection of the trailing edge of the sheet is detected by sheet ejection sensor 192 of image forming device 100, the detected information is received by first receiving section 230 from image forming device 100, and the controller 210 accelerates the conveying speed in sheet conveying device 200 to conveying speed V3 that is the same as conveying speed V3 for feeding in a sheet in post-processing device 300.

Feed-in roller 241 feeds the sheet ejected from image forming device 100 into sheet conveying device 200.

Memory section 280 stores data to be used for various types of processing conducted by sheet conveying device 200 and data generated by various types of processing conducted by sheet conveying device 200. In the memory section 280, there are stored information of conveying speed (V1) for ejecting a sheet by image forming device 100 and information on conveying speed (V3) for feeding in a sheet into post-processing device 300.

Sheet ejection roller 246 ejects a sheet to post-processing device 300.

AS shown in FIG. 2, post-processing device 300 is equipped with controller 310, transmission section 320, reception section 330, feed-in roller 341, post-processing section 350, memory section 360 and sheet ejection section 370.

Controller 310 controls respective portions of post-processing device 300 on an overall control basis. The controller 310 is equipped with CPU, ROM and RAM, and CPU reads out a program stored in ROM, then, loads the program into a work area in RAM, and carries out various types of processing in collaboration with the programs.

Transmission section 320 transmits data to sheet conveying device 200. For example, the transmission section 320 transmits information on conveying speed (V3) for feeding in a sheet in post-processing device 300 and information on a type of post-processing to sheet conveying device 200, at the time of power-on.

Reception section 330 receives data from sheet conveying device 200. For example, the reception section 330 receives, from sheet conveying device 200, information on a sheet type and information on image forming, during image forming operation.

Feed-in roller 341 feeds in the sheet ejected from sheet conveying device 200 into post-processing device 300.

Post-processing section 350 is equipped with a punch processing section (not shown), a folding processing section (not shown), staple processing section 351 and stacker 352, and conducts post-processing such as punch processing, folding processing and staple processing for the sheet ejected from sheet conveying device 200 to be fed in.

Memory section 360 stores data to be used in respective types of processing conducted by post-processing device 300 and data generated by respective types of processing conducted by post-processing device 300.

Sheet ejection section 370 has fixed sheet ejection tray 371 or up-and-down sheet ejection tray 372, and ejects a sheet.

Next, operations in the present embodiment will be described.

Figure 3:
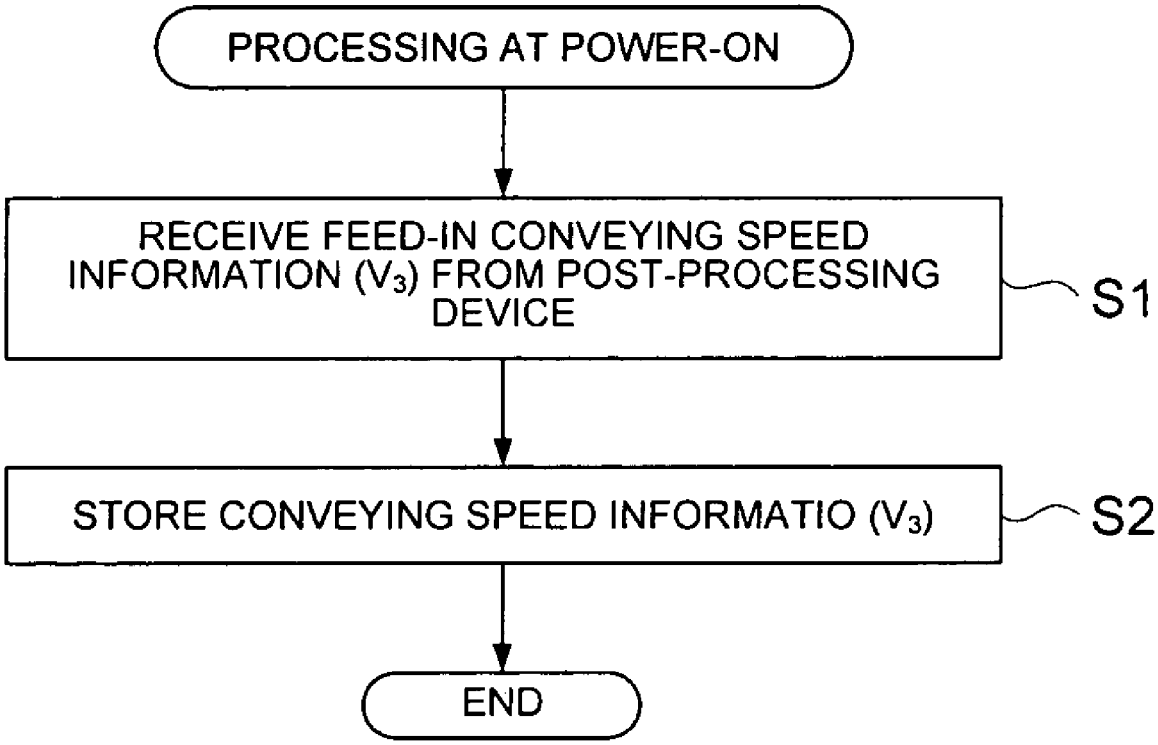
FIG. 3 is a flow chart showing processing at the time of power-on carried out by sheet conveying device 200.

FIG. 3 is a flow chart showing processing carried out by controller 240 of sheet conveying device 200 at the time of power-on.

First, when the power of image forming system 1 is turned on, information on conveying speed (V3) for feeding in a sheet by post-processing device 300 is transmitted to sheet conveying device 200 from transmitting section 320 of post-processing device 300. In the sheet conveying device 200, information of conveying speed (V3) for feeding in from the post-processing device 300 is received by second receiving section 260 (step S1) to be stored in memory section 280 (step S2).

Thus, the processing at the time of power-on is terminated.

Figure 4:
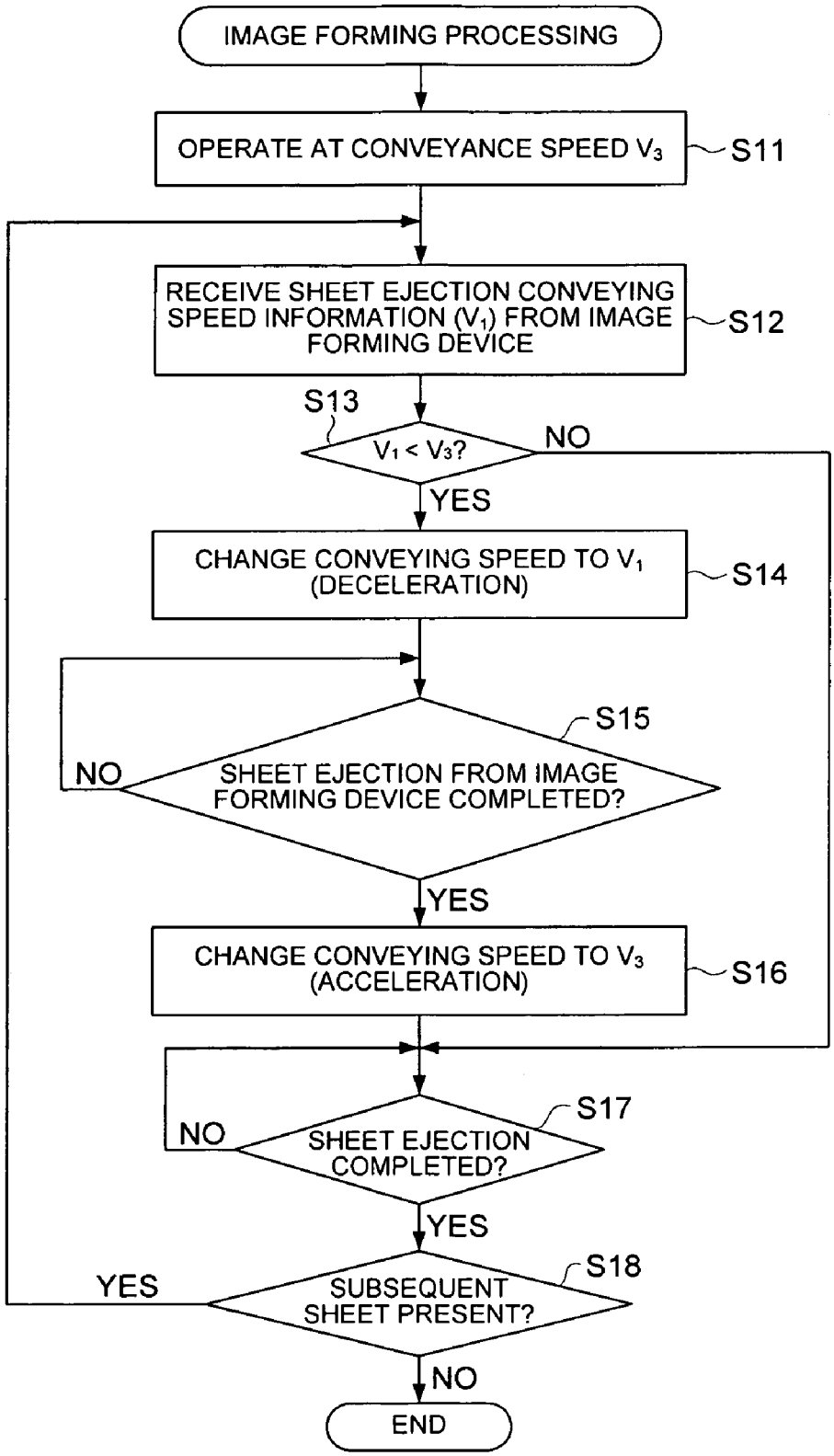
FIG. 4 is a flow chart showing processing carried out by sheet conveying device 200, during image forming operation.

Next, FIG. 4 is a flow chart showing the processing carried out by controller 240 of the sheet conveying device 200 during image forming operation.

First, when image forming device 100 starts image forming operation, feed-in roller 241, conveying rollers 242, 243, 244 and 245 and sheet ejection roller 246 are started to be driven by control of controller 240, at conveying speed V3 that is the same as conveying speed V3 for feeding-in by post-processing device 300, in the sheet conveying device 200 (step S11).

When the leading edge of a sheet to be ejected is detected by sheet ejection sensor 192 of image forming device 100, namely, immediately before the sheet is ejected from image forming device 100, information on conveying speed (V1) for ejecting a sheet by image forming device 100 is transmitted from transmitting section 170 of image forming device 100 to sheet conveying device 200. In the sheet conveying device 200, information on conveying speed (V1) for sheet ejection is received from image forming device 100 by first receiving section 230 (step S12) to be stored in memory section 280.

Herein, when conveying speed V3 for feeding-in by post-processing device 300 is higher than conveying speed V1 by image forming device 100 (step S13; Yes), controller 210 controls driving of feed-in roller 241, conveying rollers 242, 243, 244 and 245 and sheet ejection roller 246 so that the conveying speed in sheet conveying device 200 is changed to the conveying speed that is the same as conveying speed V1 for sheet ejection by image forming device 100, wherein controller 210 decelerate the conveying speed from conveying speed V3 to conveying speed V1 (step S14).

Then, the sheet ejected from image forming device 100 by conveying speed V1 is fed in by feed-in roller 241 of sheet conveying device 200. When the trailing edge of the sheet ejected is detected by sheet ejection sensor 192 of image forming device 100, namely, when sheet ejection from image forming device 100 is completed (step S15; Yes), controller 240 controls driving of feed-in roller 241, conveying rollers 242, 243, 244 and 245 and sheet ejection roller 246 so that the conveying speed is changed to the conveying speed V3 that is the same as the conveying speed V3 by post-processing device 300, wherein controller 240 accelerates the conveying speed from conveying speed V1 to conveying speed V3 (step S16). Incidentally, since it is necessary to complete the change of conveying speed before the leading edge of the sheet is ejected from sheet conveying device 200, the length of conveying path 201 of sheet conveying device 200 is set such that the condition by the following expression is satisfied.

(length of conveying path 201 of sheet conveying device 200)≧(length, in the conveying direction, of maximum sheet size processable by image forming system 1)

After step S16, or when conveying speed V3 of post-processing device 300 in step S13 is not higher than conveying speed V1 of image forming device 100 (step S13; No), it is judged whether the sheet ejection is completed or not for post-processing device 300 in sheet conveying device 200 (step S17). Completion of the sheet ejection by sheet conveying device 200 is judged based on detection of the trailing edge of the sheet by entrance sensor 342 of post-processing device 300.

If the sheet ejection by sheet conveying device 200 to post-processing device 300 is completed (step S17; Yes), it is judged whether a sheet to be ejected next is present or not (step S18). When a subsequent sheet is present (step S18; Yes), the flow goes back to step S12, then, information on conveying speed (V1) for ejection of the subsequent sheet is received, and processing by steps S12 to S18 are repeated.

When a subsequent sheet is not present in step S18 (step S18; No), processing is terminated.

The sheet ejected from sheet conveying device 200 is fed in by post-processing device 300 at conveying speed V3, and is ejected after being subjected to post-processing.

As stated above, in the image forming system 1, sheet conveying device 200 feeds in a sheet at conveying speed V1 that is the same as conveying speed V1 for sheet ejection by image forming device 100, and when the trailing edge of the sheet is ejected from image forming device 100, sheet conveying device 200 accelerates the conveying speed to conveying speed V3 that is the same as conveying speed V3 for feeding-in by post-processing device 300. Therefore, it is possible to prevent uneven gloss caused by acceleration in the course of delivery in conveying of the sheet from image forming device 100 to post-processing device 300.

Further, in sheet conveying device 200, information on feed-in speed (v3) for feeding-in by post-processing device 300 is received at the time of power-on, and information on sheet ejection speed (v1) for sheet ejection by image forming device 100 is received during image forming operation. Therefore, even when information on sheet ejection speed (V1) for sheet ejection at image forming device 100 and information of feed-in speed (V3) for feeding-in by post-processing device 300 are not stored in sheet conveying device 200, it is possible to cope with various combinations of image forming device 100 and post-processing device 300, and thereby to enhance general versatility.

Further, since it is not necessary to provide a control mechanism for acceleration and deceleration for neither image forming device 100 nor post-processing device 300, it is possible to relieve the load required for a control mechanism and the like for image forming device 100 and post-processing device 300.

Further, in case of connecting various types of post-processing devices and image forming devices, the use of sheet conveying device 200 of a single type is sufficient, and it is possible to select a combination of an image forming device and a post-processing device freely.

Herein, the description of the aforesaid embodiment is an example of an image forming system relating to the invention to which the invention is not limited. Detailed structures and detailed operations of each device constituting the system may also be modified without departing from the spirit and scope of the invention.

In accordance with the invention, since a sheet conveying device accelerates the conveying speed of a sheet in the device, it is possible to prevent uneven glossiness which would be caused by a change in a conveying speed due to acceleration if a sheet be conveyed from an image forming device to a post-processing device without the above described conveying device between them.

Further, even without storing information on conveying speed for ejection of a sheet by an image forming device nor conveying speed for feeding in the sheet by a post-processing device, the sheet conveying device is applicable to various combinations of an image forming device and post-processing device, achieving a high versatility.

What is claimed is:

1. A sheet conveying device connected between an image forming device for forming an image and a post-processing device of which sheet conveying speed is higher than a sheet conveying speed of the image forming device, wherein the sheet conveying device comprising:

a feed-in roller for feeding in a sheet ejected from the image forming device;

a conveying roller for conveying the sheet;

an ejection roller for ejecting the sheet to the post-processing device;

a conveying path from the feed-in roller to the ejection roller;

a first receiving section for receiving, from the image forming device connected in an upstream side of the sheet conveying device, ejection conveying speed information which is particular to the image forming device and indicates the conveying speed at which the image forming device ejects the sheet;

a second receiving section for receiving, from the post-processing device connected in a downstream side of the sheet conveying device, feed-in conveying speed information which is particular to the post-processing device and indicates the conveying speed at which the post-processing device feeds in the sheet; and a controller for controlling sheet conveying speeds of the feed-in roller, conveying roller, and ejection roller, based on the ejection conveying speed information which is received from the image forming device and based on the feed-in conveying speed information which is received from the post-processing device, wherein the controller performs control such that:

when the sheet conveying device feeds in the sheet ejected from the image forming device, the conveying speeds of the feed-in roller, conveying roller, and ejection roller are changed to the same as a conveying speed at which the image forming device ejects the sheet; and when the image forming device has completed ejection of a trailing edge of the sheet, the conveying speeds of the feed-in roller, conveying roller, and ejection roller are changed to the same as a conveying speed at which the post-processing device feeds in the sheet.

2. The sheet conveying device of claim 1, wherein a length of the conveying path is longer than a length of a maximum sheet size processable by the image forming device and the post-processing device, the length being along a conveying direction.

3. The sheet conveying device of claim 2, wherein the conveying path is flexed.

4. The sheet conveying device of claim 1, wherein the conveying path is longer than a linear distance from the conveying roller to the ejection roller.

5. An image forming system, comprising:

an image forming device for forming an image;

a post-processing device of which sheet conveying speed is higher than a sheet conveying speed of the image forming device; and a sheet-conveying device, connected between the image forming device and post-processing device, for feeding in a sheet ejected from the image forming device and ejecting the sheet to the post-processing device, the sheet-conveying device including:

a feed-in roller for feeding in a sheet ejected from the image forming device;

a conveying roller for conveying the sheet;

an ejection roller for ejecting the sheet to the post-processing device;

a conveying path from the feed-in roller to the ejection roller;

a first receiving section for receiving, from the image forming device connected in an upstream side of the sheet conveying device, ejection conveying speed information which is particular to the image forming device and indicates the conveying speed at which the image forming device ejects the sheet;

a second receiving section for receiving, from the post-processing device connected in a downstream side of the sheet conveying device, feed-in conveying speed information which is particular to the post-processing device and indicates the conveying speed at which the post-processing device feeds in the sheet; and a controller for controlling sheet conveying speeds of the feed-in roller, conveying roller, and ejection roller, based on the ejection conveying speed information which is received from the image forming device and based on the feed-in conveying speed information which is received from the post-processing device, wherein the controller performs control such that:

when the sheet conveying device feeds in the sheet ejected from the image forming device, the conveying speeds of the feed-in roller, conveying roller, and ejection roller are changed to the same as a conveying speed at which the image forming device ejects the sheet based on the ejection conveying speed information received by the first receiving section; and when the image forming device has completed ejection of a trailing edge of the sheet, the conveying speeds of the feed-in roller, conveying roller, and ejection roller are changed to the same as a conveying speed at which the post-processing device feeds in the sheet based on the feed-in conveying speed information received by the second receiving section.

6. The image forming system of claim 5, wherein a length of the conveying path is longer than a length of a maximum sheet size processable by the image forming device and the post-processing device, the length being along a conveying direction.

7. The image forming system of claim 6, wherein the conveying path is flexed.

8. The image forming system of claim 5, wherein the conveying path is longer than a linear distance from the conveying roller to the ejection roller.

* * * * *